US006439610B1

(12) United States Patent
Pronzati

(10) Patent No.: US 6,439,610 B1
(45) Date of Patent: Aug. 27, 2002

(54) STICK HANDLE FOR SKI, TREKKING AND THE LIKE WITH ADJUSTABLE WRIST STRAP

(75) Inventor: Attilio Pronzati, Vanzago (IT)

(73) Assignee: Gipron Giuseppe Pronzati S.p.A., Vanzago (IT)

( * ) Notice: Subject to any disclaimer, the term of this patent is extended or adjusted under 35 U.S.C. 154(b) by 0 days.

(21) Appl. No.: 09/573,049

(22) Filed: May 18, 2000

(30) Foreign Application Priority Data

May 18, 1999 (IT) ..... MI990325 U
Sep. 22, 1999 (EP) ..... 99118735

(51) Int. Cl.[7] ..... A63C 11/22; A44B 11/06
(52) U.S. Cl. ..... 280/822; 24/191; 24/265 EC
(58) Field of Search ..... 280/819, 820, 280/821, 822; 135/76; 24/191, 170, 265 BC, 265 EC

(56) References Cited

U.S. PATENT DOCUMENTS 2,442,266 A * 5/1948 Davis ..... 280/822
3,297,333 A * 1/1967 Schwedt et al. ..... 280/822
3,560,014 A * 2/1971 Bruckl ..... 280/822
4,005,872 A * 2/1977 Rischert et al. ..... 280/822
4,057,261 A * 11/1977 Koblick ..... 280/822
4,130,293 A * 12/1978 Hinterreiter ..... 280/822
4,288,100 A * 9/1981 Aho ..... 280/822
4,288,101 A * 9/1981 Aho ..... 280/822
4,593,933 A * 6/1986 Nunno ..... 280/822
4,779,896 A * 10/1988 Ingalls ..... 280/822
5,470,108 A * 11/1995 Goode et al. ..... 280/822
5,806,145 A * 9/1998 Chen ..... 24/170
6,029,320 A * 2/2000 Monneret et al. ..... 24/170

FOREIGN PATENT DOCUMENTS

AT 296841 2/1972

* cited by examiner

*Primary Examiner*—Brian L. Johnson
*Assistant Examiner*—Jeffrey J Restifo
(74) *Attorney, Agent, or Firm*—Young & Thompson

(57) ABSTRACT

A stick handle for ski, trekking and the like, equipped with an improved device for adjusting the wrist strap. An operating lever is equipped with a cam pawl which allows to obtain an effective blocking of the wrist strap for a variety of thickness of the strip of the wrist strap itself. One end of the wrist strap is connected to an elastic element which automatically returns it into a housing of the stick handle.

9 Claims, 4 Drawing Sheets

STICK HANDLE FOR SKI, TREKKING AND THE LIKE WITH ADJUSTABLE WRIST STRAP

BACKGROUND OF THE INVENTION

The present invention refers to a stick handle for ski, trekking and the like, equipped with an adjustable wrist strap, which is apt to tie the user wrist round.

A stick for ski or for trekking generally comprises a rod having a tip on one of its ends, and a handle on the other end.

DESCRIPTION OF THE RELATED ART

The tip, generally made of metal, is apt to penetrate snow, ice or quite soft fields, as well as to grip a more solid field. The handle, generally made of plastic or composite material, has an ergonomic shape suitable to be easily tighten by the hand of the user. A strap, generally made of leather or synthetic material and commonly called wrist strap, is connected to the handle. The wrist strap is closed like a ring in order to form a loop apt to tie the user wrist round, so as to guarantee a steady grip and to avoid the loss of the stick.

In order to better perform its function, the wrist strap must be correctly tied round the wrist of the user and hence the wideness of its loop shall be apt to be adjusted.

In sticks according to the prior art, the loop adjustment of the wrist strap generally is obtained through a buckle. Infact, these wrist straps comprise two strips of belt connected to the stick handle. One of these two strips of belt has on its end a buckle, wherein the free end of the other strip is apt to be inserted and adjusted.

This system appears very uncomfortable for the user, especially in rigorous environmental conditions when the hands wear gloves, and it takes too long time to adjust the wrist strap.

The prior art also offers other adjusting systems for the wrist strap. For example EP-A-202,287 discloses a stick handle for ski, wherein the handle has a cam lever which can be operated by the hand of the user. Upon forming a loop of the desired dimension, the cam lever is closed pinching the strips of the wrist strap against a surface of the handle; the two free ends of the loop lay between the lever and the main body of the handle and then they come out below, parallel to the rod of the stick.

In U.S. Pat. Nos. 3,560,014, 4,288,100 and 4,288,101 a device equipped with a cam lever and arranged on the upper part of the stick handle, is shown. The part of the wrist strap in excess is untidily gathered in a restricted housing inside the handle or is just let come out from the stick handle itself.

Nevertheless, in all these cases it has been noticed that the wrist strap is not enough steadily blocked, since the strips are almost "punctually" pinched—infact, the cam has a sharpened outline—and as a consequence, the friction surface is quite reduced. That implies a trend of the wrist strap to disengage itself from the cam of the lever, especially when it is subjected to repeated efforts, as in the case of use for the northern ski (known also as cross-country skiing). Moreover, the blocking of the wrist strap by this devices with the cam lever is absolutely ineffective if the thickness of these strips is not exactly the same as the expected one in the design. Infact, if the thickness of the strip is lesser or greater than the expected one, the cam lever is not able to steadily block the wrist strap or, respectively, it cannot be completely closed to the expected position. This is a serious drawback, because, as known, in the industrial production of sticks is neither always possible nor suitable to manufacture strips for wrist straps with a repeatable thickness and a restricted tolerance.

Finally, at least the free end of the adjustable strip of the strap is annoying to menage, because of its variable length.

SUMMARY OF THE INVENTION

An object of the present invention is to eliminate these drawbacks, providing a stick handle for ski, trekking and the like equipped with a device for adjusting the wrist strap which is comfortable and, at the same time, reliable.

Another object is to provide a stick handle wherein the adjusting device of the wrist strap can be correctly closed, tightly blocking the wrist strap, also for a thickness of strips which is not constant.

Another object of the present invention is to provide a stick handle equipped with a device for adjusting the wrist strap, wherein the part of the wrist strap with a variable length can be automatically and ordinarily accommodated inside the handle itself, so as to be hidden from the outside.

These objects are achieved, according to the invention, by the features listed in the enclosed claims.

A stick handle for ski, trekking and the like with an adjustable wrist strap, according to the present invention, provides on its upper part, an opening/closing lever housed in a corresponding seat located in the upper part of the stick handle. Inside this seat the wrist strap is made pass in such a way as to externally protrude from the stick handle to form a loop apt to tie the user wrist round. The opening/closing lever works as a cover for the stick handle and it is also pivoted in the upper rearward part of the same handle. In this way the opening/closing lever can swing from an open position, wherein the length of the wrist strap can be adjusted by making it slide in its own seat, to a close position, wherein the wrist strap is firmly blocked in its seat.

The cam lever has also a pivoting pawl apt to grip the wrist strap for any thickness of the strips, within a certain range, allowing to the main opening/closing lever to always reach its condition of optimal closing.

Elastic returning means to automatically retract the free adjustable end of the wrist strap into the stick handle, are also provided.

BRIEF DESCRIPTION OF THE DRAWINGS

Further characteristics of the invention will be clarified from the detailed description which follows, referring to a purely exemplary embodiment thereof, and thus not limiting, as illustrated in the enclosed drawings, wherein.

DESCRIPTION OF THE PREFERRED EMBODIMENT

Making reference to the drawings, a stick handle for ski with an adjustable wrist strap according to the invention, is described.

Figure 1:
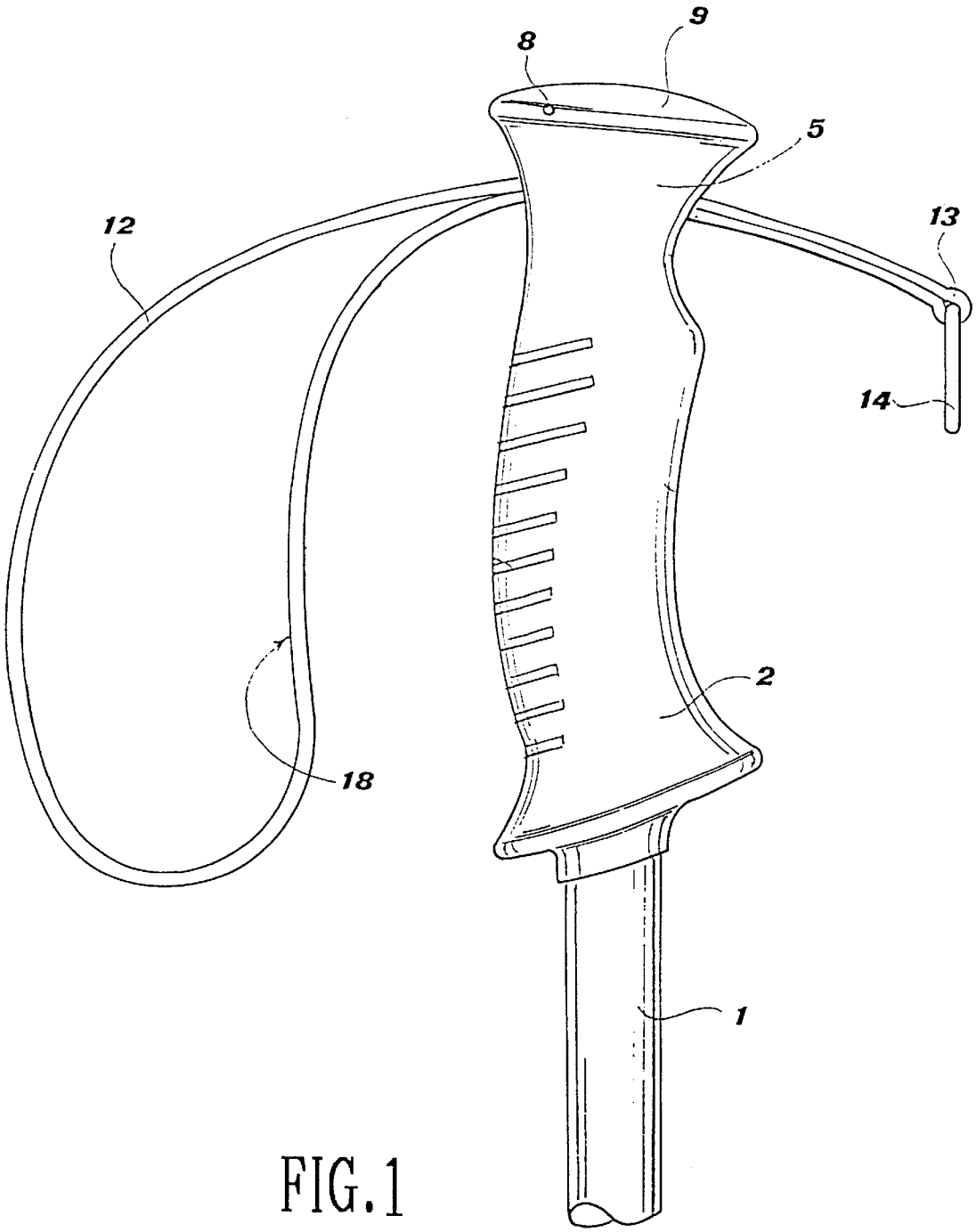
FIG. 1 is a lateral elevation view of the upper part of a stick for ski with a device for adjusting the wrist strap, according to a first embodiment of the invention.
Figure 2:
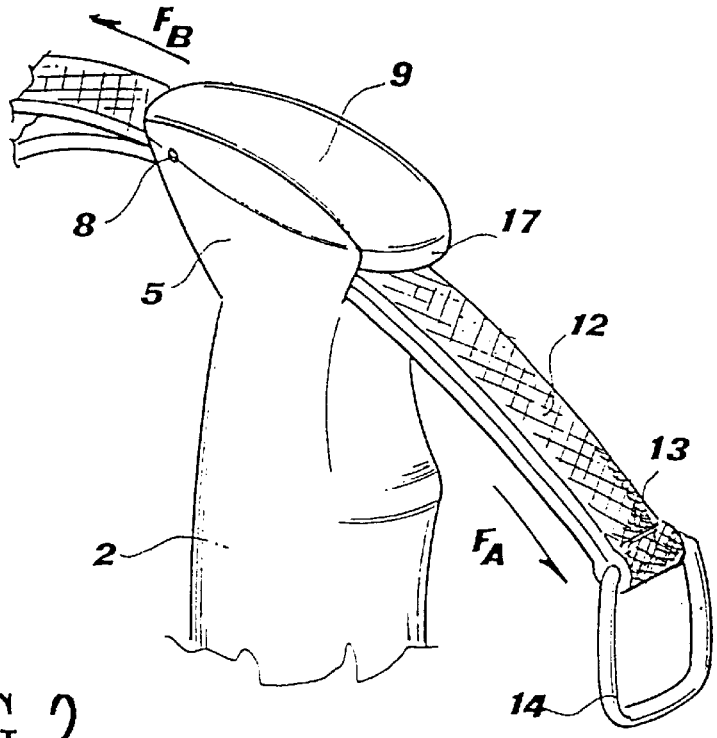
FIG. 2 is a partial perspective view of the stick handle as shown in FIG. 1.

A stick for ski comprises a tubular rod 1 on which end a stick handle 2 is fixed. The rod 1, shown as interrupted in FIG. 1, is generally manufactured by a light metallic material, such as aluminium alloy. The rod 1 has, on its free end,a tip (which is not shown) apt to penetrate snow, ice or field in general.

The handle 2 is generally made of plastic or other suitable synthetic material. It has a substantially cylindrical shape provided with swellings and ergonomic depressions apt to accommodate hand fingers for ease of grip.

Figure 3:
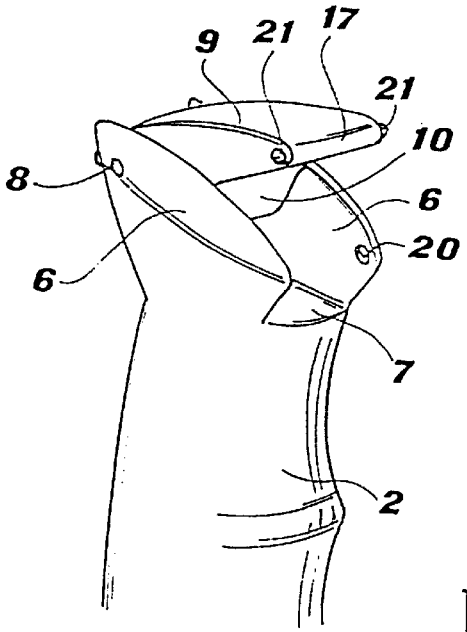
FIG. 3 is a view as in FIG. 2, wherein the wrist strap doesn't appear and the opening/closing lever of the handle is in an open position.

The handle 2 terminates with an upper part 5 having a substantially elliptical cross section, with bigger dimensions than the remaining of the stick handle. As shown in FIG. 3 the upper part 5 is formed by two walls 6 projecting upwards and parallel to each other in order to delimit a seat 7.

The seat 7 has a substantially flat bottom and it is apt to receive the wrist strap 12. The wrist strap 12 can be made of leather or suitable synthetic material strips 15 and 16, closed to form a loop 18 which would tie the user wrist round. The wrist strap 12 is then loop closed and inserted into the seat 7 so as to protrude from side to side of the seat itself.

Figure 4:
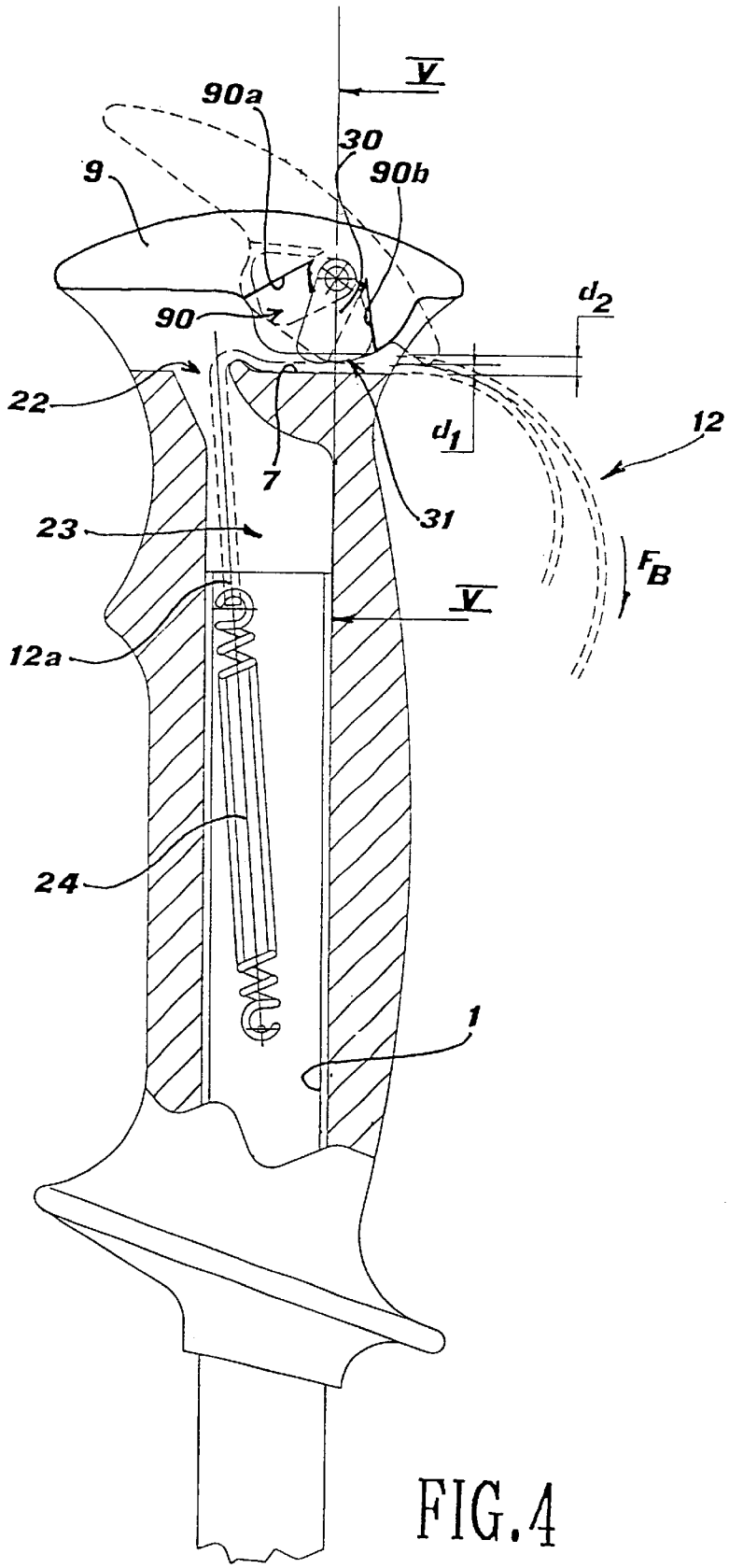
FIG. 4 is a partial section view, similar to FIG. 1, of a second preferred embodiment of the invention.

Between the walls 6 of the seat 7 an opening/closing or operating lever 9 is pivotally mounted through a pin 8 arranged in the proximity of a rearward end (from the point of view of a user who grips the stick) of the lever itself, as it can be seen in FIG. 4. The lever 9 has an upper surface shaped as a rounded ellipsoid and it has such a dimension to superiorly close and complete the seat 7, working as a cover for the stick handle, without creating any discontinuity of the upper part 5.

The two walls 6, in their forward part, have respectively two seats 20 (FIG. 3). The lever 9 has at its forward part, two fins or little pins 21 protruding towards the outside and lightly flexible, placed on two lateral opposite sides, in correspondence of seats 20. In this way, when the lever 9 is closed, the fins 21 are engaged into the respective seats 20 of the walls 6, avoiding in this way possible casual opening of the lever itself. Obviously, the position of the fins 21 and of the seats 20 can be inverted.

Figure 5:
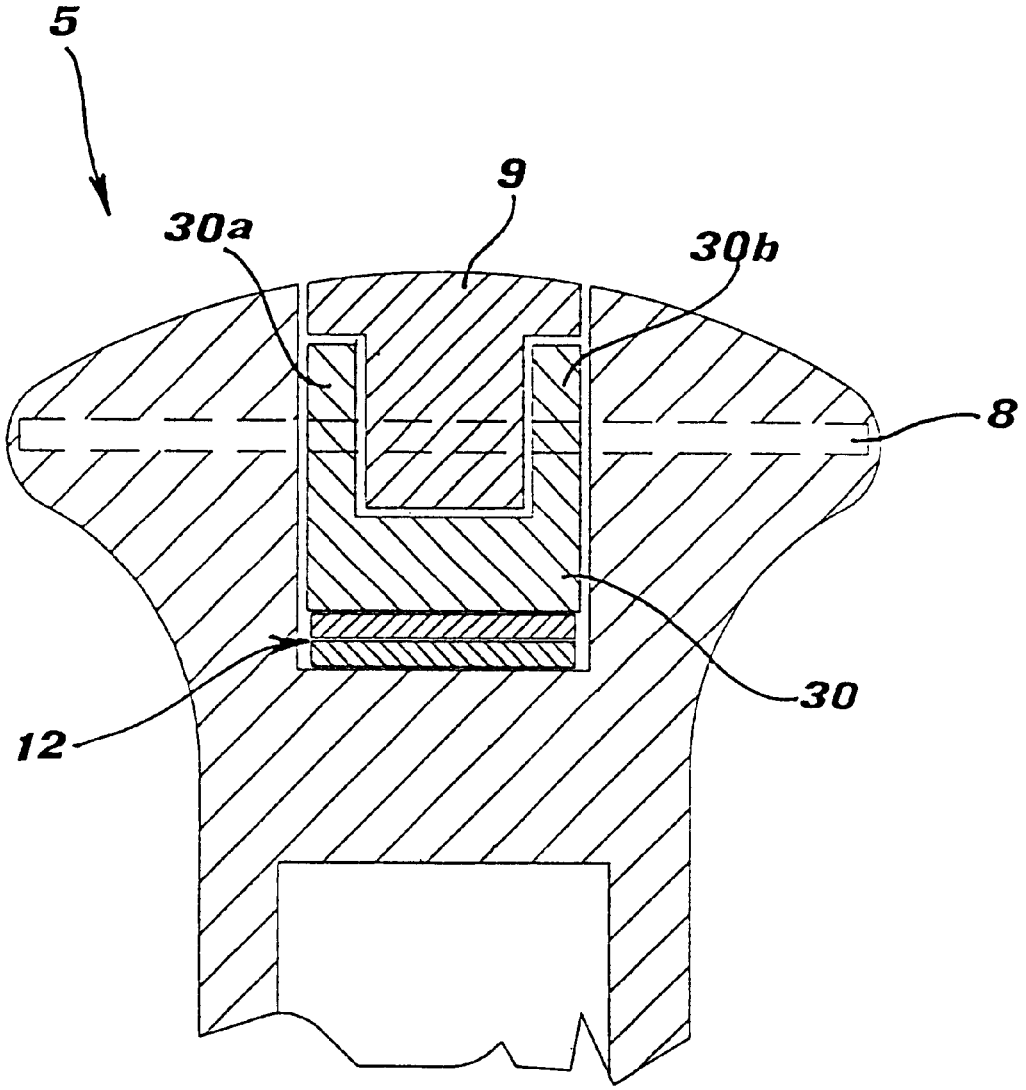
FIG. 5 is a partial section view along the V—V line of FIG. 4.

According to the present invention, the lever 9 also comprises a pivoting pawl 30 having a lower surface 31 with an eccentric cam (FIG. 5). The pawl 30 has superiorly two fork arms 30*a* and 30*b*, by which said pawl is assembled to the lever 9, preferably rotating around the pin 8 itself. The cam surface 31 is eccentric in the sense that it presents an increasing distance from the rotation axis 8 of the pawl 30. As an advantage, the eccentric surface 31 has a distance from the axis 8 increasing in the clockwise direction as in FIG. 4. This is particularly useful to the purpose which will explained ahead.

The pawl 30 is received into a housing 90 of the lever 9 defined by two beat walls 90*a* and 90*b*, respectively forward and rearward. The two beat walls 90*a* and 90*b* limit the maximum angular stroke allowed to the pawl 30. In correspondence, the available clearance for wrist strap, which is to say the distance between the cam surface 31 of the pawl 30 and the bottom surface of the seat 7, changes from a minimum d1, when the pawl is abutting the rearward beat wall 90*b*, and a maximum d2, when the pawl is abutting the forward beat wall 90*a*. For all the other intermediate positions of the pawl 30, an available clearance for the wrist strap 12, variable in continuity from d1 and d2, is obtained.

From a practical point of view, when the wrist strap 12 is inserted in its seat 7, the cam lever 9 can be perfectly closed, without worrying about the thickness of the wrist strap 12. Infact, the pawl 30, as a matter of gravity, rests against the wrist strap (whatever its thickness is, from a minimum of about d1 to a maximum of about d2), by rotating by an angle which is allowed by the thickness of the specific used wrist straps. Once the cam surface 31 is engaged by friction with the wrist strap, this latter can be lightly extracted in the direction FB to make the pawl 30 further rotate in the counter clockwise direction in FIG. 4, so that the eccentric surface 31 further approaches the bottom of the seat 7 and the clearance available to the wrist strap 12 further reduces, which strap is thus firmly pinched.

When the user desires to open the device for adjusting the wideness of the loop 18, he pushes the forward part 17 of the cam lever 9 up—by inserting a finger in the seat 7 beneath the forward part 17 of the lever 9, or by exerting upward traction on the free end 13 of the wrist strap 12—to make the cam lever 9 rotate around the axis of the pin 8 and open it (the position in phantom-line in FIG. 4). Upon the rotation around the pin 8, the beat wall 90*b* moves against the pawl 30 making it rotate until it disengages the underlying wrist strap 12. In this condition it is possible to carry out the adjustment: if the user wants to tighten the loop he will drag the strips 15 and 16 in the direction of the arrow FA, if he wants to widen the loop 18, he will grasp the wrist strap 12 from the rearward side of the stick handle and he will drag it in the direction of the arrow FB. Once the loop 18 is adjusted in its proper dimension, the user brings the lever 9 back in the blocking position, through a manual pressure on the upper surface thereof.

An object of the invention has been thus achieved. As a matter of fact, the adjustment device of the invention is comfortable to operate in every condition and it is apt to perfectly block wrist straps of different thickness over a predetermined range d1–d2, for example from 2,5 mm to 3,5 mm.

In a first embodiment, the wrist strap 12 has, on its end 13 which forwardly protrudes from the stick handle 2, a rigid ring 14, with a substantially rectangular shape, made of metal or plastic material, apt to be grasped from the user to drag the wrist strap 12. The ring 14 also works as a stop for the wrist strap 12, avoiding the wrist strap to be discharged from the seat 7. The ring 14 can also have any other shape.

According to another preferred embodiment of the invention, at least an adjustable end 12*a* of the wrist strap 12 (the other end could just be anchored to the stick handle) instead of forwardly protruding, is inserted, through an opening 22 of the seat 7, in an interior housing 23 of the handle itself and it is attached to a first end of an elastic returning element 24. The housing 23 preferably extends also inside the tubular rod 1.

The second end of the elastic returning element 24, for example in the form of a helicoidal spring, is internally fixed in the housing 23 or, better, is fixed inside the rod 1.

In this way, the part of the wrist strap with a variable length can be hidden and accommodated inside the handle 2 and/or the rod 1. If, during the adjustment, the loop 18 is requested to be widened, a part of the wrist strap 12 will be extracted in the direction FB, yelding the elastic element; while, if the loop 18 is requested to be tighten, the blocking of the cam lever will be loosen, letting the elastic element 24 automatically return a part of wrist strap in the direction opposite to FB.

Thus, another object of the invention has been achieved.

It is intended that the invention is not limited to the specific embodiments illustrated above, which are just some not restrictive examples of the teaching of the invention, but that also many variations are possible and can all be reached by the skilled of the field, without departing from the scope of the invention itself.

For example, the cooperating surfaces of the pawl 30 and of the bottom of the seat 7 could be provided with various roughness (such as an indentation or a knurling) to enhance the friction coefficient and thus to increase the blocking effect of the wrist strap.

Moreover, the elastic element 24, instead of being a helicoidal spring, could be an elongated element made of elastomer or a specific portion of the wrist strap itself made of elastic or extensible material.

What is claimed is:

1. Stick handle (2) for ski, trekking and the like, with adjustable wrist strap (12), comprising:

an operating lever (9), pivotally mounted on a pin (8) and apt to block said wrist strap (12) inside a seat (7), located in an upper part (5) of said handle (2), said operating lever (9) comprising a distinct pawl (30) pivoting with respect to said operating lever, having an eccentric cam outline (31) approachable to a bottom surface of said seat (7) with which it is apt to pinch and block said wrist strap (12), wherein, said pawl (30) is pivoted between a first position and a second position in which its eccentric cam outline (31) has respectively a minimum and a maximum distance from the bottom of said seat (7), and said pawl in the first position abuts a rearward beat wall of a housing provided on said operating lever and said pawl in the second position abuts a forward beat wall of the housing.

2. Stick handle as in claim 1, wherein said pawl is pivoted on an axis parallel to said pin (8) of the operating lever (9).

3. Stick handle as in claim 2, wherein said pawl (30) pivots on the same pin (8) of the operating lever (9).

4. Stick handle as in claim 1, wherein said rearward beat wall **(90*b*) is apt to be kept in contact with said pawl (30) during the opening of the operating lever (9), so that the pawl is rotated, disengaging the wrist strap (12)**.

5. Stick handle as in claim 4, wherein said operating lever (9) has an upper surface apt to complete, without any discontinuity, the upper part (5) of the handle.

6. Stick handle as in claim 5, wherein said upper part (5) of the handle and said operating lever (9) have, respectively, mutual engaging means (20, 21) to block said lever, (5) in the close position.

7. Stick handle as in claim 1, wherein at least one of the ends of said wrist strap (12) is received into an accommodating housing (23), at least defined inside said stick handle and communicating to said seat (7), said end being attached to an elastic returning element (24).

8. Stick handle as in claim 1, further comprising an accommodating housing (23), defined at least inside said handle and communicating to said seat (7), wherein at least one end of the wrist strap (12) is received and is attached to an elastic returning element (24).

9. Stick handle as in claim 8, wherein said accommodating housing (23) extends in a tubular rod (1) forming a structure of the stick, said elastic element being anchored to said tubular rod (1).

* * * * *